US005401058A

United States Patent [19]

Holmberg

[11] Patent Number: 5,401,058

[45] Date of Patent: Mar. 28, 1995

[54] REINFORCED PAPER TABS

[76] Inventor: Thomas Holmberg, 4155 Bershire La. N., Plymouth, Minn. 55446

[21] Appl. No.: 792,951

[22] Filed: Nov. 15, 1991

[51] Int. Cl.[6] ..... B42D 15/00

[52] U.S. Cl. ..... 283/62; 281/2; 281/5; 40/641

[58] Field of Search ..... 281/2, 5; 283/62; 40/641

[56] References Cited

U.S. PATENT DOCUMENTS

| | | | |
|---|---|---|---|
| 1,743,191 | 1/1930 | Charlton . | |
| 2,037,579 | 4/1936 | Jonas | 129/16.8 |
| 2,052,623 | 9/1936 | Harby | 93/1 |
| 2,138,788 | 11/1938 | Hart et al. | 93/1 |
| 4,447,481 | 5/1984 | Holmberg et al. | 428/40 |
| 4,551,374 | 11/1985 | Holmberg | 281/5 X |
| 4,560,600 | 12/1985 | Yellin et al. | 281/5 X |
| 4,588,463 | 5/1986 | Barber et al. | 156/200 |
| 4,662,770 | 5/1987 | Block | 281/5 X |
| 4,749,121 | 6/1988 | Barber et al. | 229/1.5 R |

OTHER PUBLICATIONS

"Xerography," *The New Illustrated Science and Invention Encyclopedia,* vol. 23, pp. 3190–3192.

*Primary Examiner*—Paul A. Bell

*Attorney, Agent, or Firm*—Gregory P. Kaihoi

[57] ABSTRACT

Reinforced paper tabs for use in xerographic reproduction equipment. The tabs include a thin reinforcing film that may optionally be recessed into the thickness of the paper sheet, or may merely be very thin with respect to the thickness of the paper sheet, thus permitting the tabbed sheets to be fed through conventional xerographic reproduction equipment for use in production of booklets and the like. Preferably the reinforcing film includes an outer heat activatable adhesive layer that is melt compatible with xerographic toner, so that xerographic images can be permanently reproduced on the reinforced tabs. The invention also relates to methods of manufacturing and collating such tabbed sheets from web stock.

12 Claims, 5 Drawing Sheets

REINFORCED PAPER TABS

FIELD OF THE INVENTION

The invention relates to paper tabs used, e.g., in dividing sections of notebooks, booklets, and the like, and in particular relates to configurations of reinforced tabs and methods of making them.

BACKGROUND OF THE INVENTION

Paper tabs are used in the office, home, school, and the like for a variety of applications. Often they are included as section dividers in a booklet or notebook to provide convenient indexing of the various sections. Although small, stick-on tabs can be provided with, e.g., a pressure sensitive adhesive allowing them to be merely attached to the edge of a page in the booklet, more often the tabs are provided as integrally formed with a sheet of paper (often of heavier stock) the same size as the booklet pages, except of course that the tab itself extends beyond one edge of the pages. Typically the tabs will be reinforced in some fashion to withstand the often heavy wear they must endure. Usually the reinforcement is accomplished by adhering a layer of Mylar ® or similar film to one or both sides of the tab.

To serve their potential function fully, preferably tabs are printed with specific information relating to the section or page(s) that they are identifying. For example, tabs segmenting a book into ten sequential sections may be printed with the numbers 1–10. Other information is also common, such as months, days, chapter titles, and the like. When custom information, tailored to a particular application, is desired, the information is sometimes manually written on the tabs. Alternately, special tabs may be used that utilize a clear plastic sleeve containing a paper insert on which is typed or printed the information to be displayed. These methods typically are not very professional looking, are not well suited to mass production of many copies, and the paper inserts often fall out of their sleeves.

To address these deficiencies, many companies have custom tabs manufactured to meet their specific needs. Unless a significant number of copies of such tabs are needed, however, this option can be quite costly.

Xerographic techniques for the production of relatively high quality booklets have recently become quite advanced. For example, Xerox Corporation currently sells a line of duplicating systems (e.g., the "Xerox 50 Series") that not only yield high quality xerographic reproductions but also collate, staple/bind, and insert front and back covers. These systems also can insert non-reinforced tabbed sheets at desired locations within the booklets, with the desired information reproduced on the body of the sheet as well as on the tab, allowing, in effect, custom printing of the tabs.

These tabbed sheets are usually of heavier stock but are otherwise not reinforced. Although copiers of this type are capable of handling heavier stock paper precut with tabs, the tabs themselves cannot be reinforced with a Mylar ®-type film, since the film typically adds about 50–100% (or more) to the thickness of one edge of the sheet. A stack of such sheets will build up thicker on the reinforced edge, making it quite uneven. Such a stack cannot be handled by the sheet feeders of these copiers.

Moreover, reinforcing films utilized to date are not particularly receptive to xerographic toner. Even if the toner initially adheres to the film, usually it is relatively easy to scrape off and/or it flakes off if the tab is flexed, bent, or creased. Thus, such films are not suited for production of high-quality custom reinforced tabs.

Although unreinforced tabs can and typically are made out of heavier stock paper, under substantial use they tend to fold or crease along the edge of the booklet pages. They also tend to delaminate, as the reader typically engages the very edge of the tab with a finger, tending to peel the upper layers of the unprotected edge away from the lower layers.

SUMMARY OF THE INVENTION

In one embodiment, the invention provides a paper sheet having a reinforced tab that is of uniform thickness (i.e., the tab is not substantially thicker than the remaining portion of the sheet). The sheet is characterized by having top and bottom surfaces, and an edge portion having a tab extending laterally therefrom. A reinforcing film is permanently secured to one of the surfaces of the tab, and desirably is at least partially recessed into the tab so that the thickness of the tab is not substantially greater than the full thickness of the remaining portion of the sheet. The uniform thickness of the sheet allows multiple sheets to be stacked in a substantially level pile, suitable for use in a copying machine.

In a related embodiment the film applied is quite thin in relation to the thickness of the paper so that even without recessing the buildup in thickness is no more than about 33%, and preferably is less than 20%. If properly stacked in a photocopier feeder, such thickness buildup can be acceptable.

In a preferred embodiment, the film consists of a polyester film base that is secured by an adhesive to the sheet, the exposed surface of the film carrying a thermally activatable adhesion layer that is melt compatible with thermoplastic xerographic toner so that the reinforcing film will accept and retain a xerographically reproduced image.

The invention also relates to a method of converting a continuous paper web into collated sets of paper sheets having cut tabs extending from an edge thereof in a selected plurality of positions. The method comprises cutting the selected tabs into the web in the desired collated order using a cylindrical die, cutting the web into individual sheets, and then stacking the sheets in the order in which they are cut to form the sets of collated sheets. This method produces reliably accurate collation, an important feature in high quality mass production of booklets in the Xerox-type duplicating systems.

The invention also relates to a method of xerographically copying an image onto a transparent substrate, the method comprising the steps of providing a transparent film having a coating of a thermally activatable adhesion layer that is melt compatible with a xerographic toner, xerographically applying the toner to the adhesion layer in the form of the image, and heat fusing the toner to the adhesion layer.

BEST MODE FOR CARRYING OUT THE INVENTION

Figure 1:
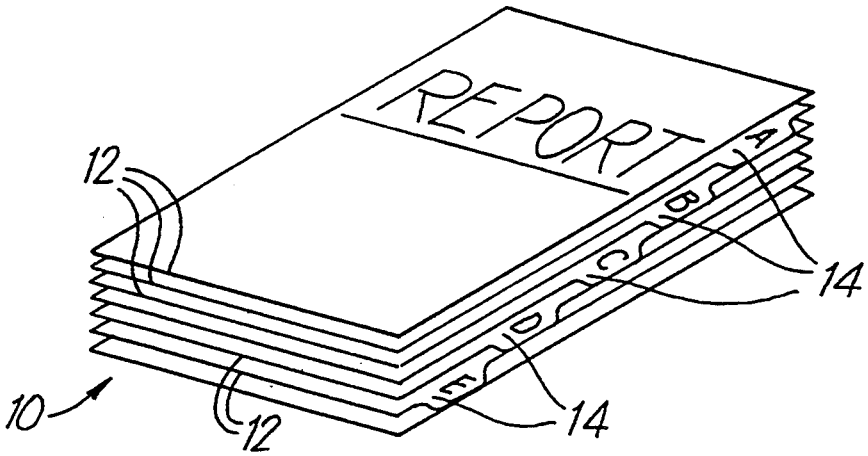
FIG. 1 is a perspective view of a booklet having tab dividers bound therein.

FIG. 1 depicts generally a booklet 10 having five tabs 14, formed integrally with paper sheets 12, on which is printed information relating to the five different sections (in this case, sections A–E) of the booklet 10.

Figure 2:
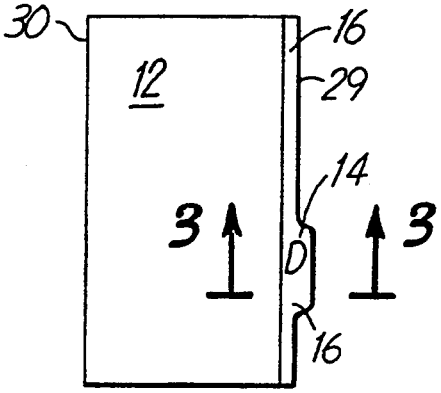
FIG. 2 is a plan view of a paper sheet with a reinforced tab of the invention.

As shown in FIG. 2, each of the tabbed sheets 12 includes a reinforcing strip 16 along the edge 29 of the sheet into which the tab 14 has been cut. It is not critical that the reinforcing strip 16 run the entire length of the sheet 12, since its primary function is served if it covers the tab itself and a portion of the sheet immediately around the tab 14 (so that the film 16 reinforces the tab and the immediately adjacent area against creasing or tearing when the tab 14 is manipulated by the reader). However, mass production techniques make the placement of such a reinforcing strip 16 along the entire length of the sheet 12 botch easy and economical, and the drawings therefore depict this preferred embodiment of the invention.

Figure 3:
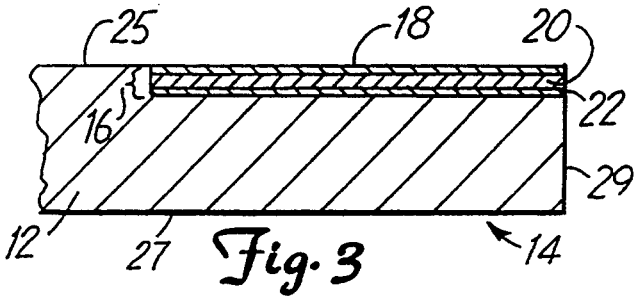
FIG. 3 is a partially broken-away cross-sectional view of the tab of FIG. 2, taken along line 3—3 thereof.
Figure 4:
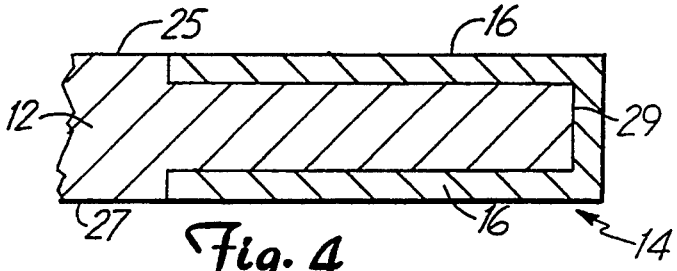
FIG. 4 is a cross-sectional view of a modified embodiment of a tab of the invention.
Figure 5A:
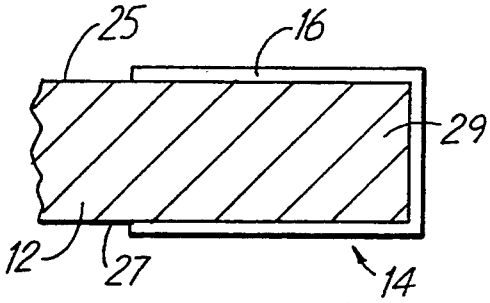
FIG. 5A is a cross-sectional view of another modified embodiment of a tab of the invention.
Figure 5:
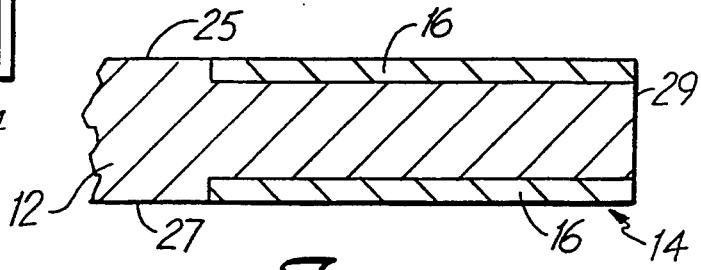
FIG. 5 is a cross-sectional view of another modified embodiment of a tab of the invention.

FIGS. 3–6 depict several different embodiments of the invention. In FIG. 3 the film 16 has been applied to and recessed in just the upper surface 25 of the tabbed sheet 12. Although this configuration does not protect the tab 14 against the delamination discussed above, it does provide some reinforcement against creasing of the tab 14 along the edge of the other pages in the booklet. FIG. 5 shows a variation of this in which such a reinforcing strip 16 is provided on both the top 25 and the bottom 27 of the tabbed sheet 12.

FIG. 4 shows another embodiment where the reinforcing strip 16 is folded around the edge 29 of the tab and secured to both the top 25 and the bottom 27 of the sheet 12. This embodiment protects the edge 29 against delamination, and therefore is a preferred configuration.

Figure 6:
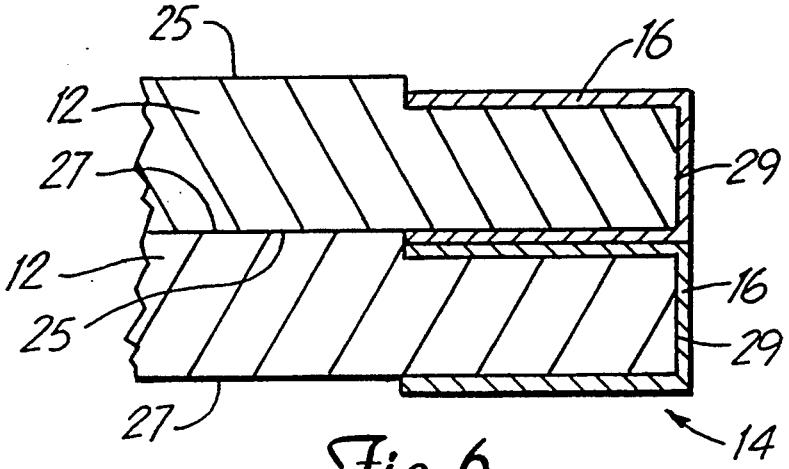
FIG. 6 is a cross-sectional view of yet another modified embodiment of a tab of the invention, showing a pair of such tabs stacked upon one another.

In each of these embodiments the reinforcing strip 16 is recessed into the sheet 16 so that the overall thickness of the reinforced tab 14 and edge portion of the sheet 12 is not increased. Methods of so recessing a strip in paper sheets are known, such as that depicted in U.S. Pat. No. 4,447,481 (incorporated herein by reference). In FIG. 4, the strip is equally recessed from the top and the bottom. In FIG. 6, the entire recess is formed in the top of the sheet 12, even though the reinforcing strip is applied to both the top and the bottom—as is illustrated in FIG. 6, this configuration will still stack properly without undue build-up of thickness on one side of the stack, since successive sheets are allowed to nest against one another.

In FIG. 5A, the film 16 is not recessed but is particularly thin—less than ⅓ the thickness of the sheet, desirable less than 1/5 the thickness of the sheet, and, in a most preferred embodiment, less than about 1/7 the thickness of the sheet 12.

For example, in a preferred embodiment, the paper sheet 12, which is heavier than ordinary copier paper, is typically about 7.5 mils thick (compared to about 4 mils for ordinary copier paper). The film, preferably to be applied to both sides of the sheet, is about 0.5 mils thick, thus adding 1 mil total thickness, increasing the thickness of the tab by about 13%. In comparison, prior art custom tabs typically might utilize a film having a thickness of about 3 mils. Applying this film to both sides of a 7.5 mil sheet would increase the thickness by 6 mils to 13.5 mils, an increase of about 80% (typically it was necessary to use such thicker films because they were usually applied only as a patch on the tab and the immediately surrounding area—applicants technique, as described below, allows economical application of much thinner films).

Although a 10–20% (or even 33%) increase in thickness of the reinforced edge 29 does cause a stack of such sheets 12 to be uneven, if properly loaded in a photocopier this unevenness is manageable. In particular, the sheets desirably are loaded with the edge 30 that is opposite the reinforced edge 29 being grabbed by the feeder. In this way, the edges 30 presented to the photocopier are level and the opposite edges 29 are not so thick as to make the stack unstable or to cause jams. For example, if the film adds 13% to the thickness of the reinforced edges 29, a stack of sheets five inches high would only be 5.65 inches high at the reinforced edge (compared to 8–10 inches, or more, using prior art techniques).

The film 16 used in the invention may be any of a variety of suitable films that can be attached to paper with an adhesive 22 and provide the desired amount of reinforcement. Mylar ® films manufactured by duPont have worked well.

In a preferred embodiment, the reinforcing film 16 includes a central film layer 20 and an outer layer 18 which is compatible with xerographic toner so that the reinforcing film will accept and retain a xerographically reproduced image. Preferably this outer layer comprises a thermally activatable adhesion layer that is melt compatible with thermoplastic xerographic toner. Thus, when xerographic toner is deposited on the film in the photocopier, the fuser of the copier, which melts the toner, will also melt (or at least soften) the adhesive layer 18 of the film 16, thus adhering the xerographic image firmly to the film. Desirably the base layer 20 of the reinforcing film has a melting/softening point above the typical temperature that is reached as the film passes the copier fuser (e.g., above about 390°–400° F.), and the outer adhesive layer 18 has a melting/softening temperature at or lower than this temperature so that the copier fuser will melt or at least soften this layer as the film passes by the fuser.

One group of films that have been found to work quite well is the Mylar OL series (which includes Mylar 50 OL, Mylar 75 OL, and Mylar 100 OL) available from duPont Polymers (Wilmington, Del.). These films, designed for use in food packaging applications, are polyester films having a heat activatable layer that typically is used to seal the film to a food container, such as ovenable polyester coated paperboard trays, CPET trays, and the like. The heat activatable layer of these duPont films can be softened by xerographic fusers of copy machines, without adversely affecting the base layer 20 of the film (which softens in the range of 425°–450° F. (220°–230° C.)). Applicant has found that by applying this film with the heat activatable layer 18 facing outward, xerographic images are fused very firmly to the film—the images are very difficult to scrape off, and do not flake off or crack when the film is flexed or folded.

In the embodiment shown in FIG. 3, the film 16 is shown somewhat schematically as having a central film layer 20, the outer adhesion layer 18, and an adhesive layer 22 which secures the film to the paper sheet 12. The adhesive layer 22 may comprise any suitable adhesive including both solvent-based and heat activated adhesives. Applicant has found that solvent-based adhesives, such as Swift No. 17841 (available from Swift Company, Omaha, Nebr.) have worked well.

In a particularly preferred embodiment, however, the adhesive layer 22 comprises a layer of heat activatable adhesive that is activatable at a temperature lower than the temperature at which the outer adhesive layer 18 is activated. Two such heat activatable adhesives that have worked well for the inner layer 22 are RL-3 and RL-6, both available from duPont. These adhesives can be activated at temperatures in the range of about 200° F. (about 95° C.), well below the temperature at which the outer layer of adhesive 18 is activated. In this way the reinforcing strip 16 can be adhered to the paper sheet 12 (by activating the inner adhesive layer 22) without activating the outer layer 18. Processing of the paper stock can be accomplished quickly, since the heat activated adhesive sets (cools) quickly and can be cut and handled virtually immediately (in contrast, solvent-based adhesives often require a longer period of time to set up, and can, e.g., gum up the cutting knives if sufficient time is not allowed).

Even though the low-temperature activated adhesive 22 is reactivated by the photocopier fuser (since the fuser is operating at a temperature high enough to activate both layers 18 and 22), in practice this does not cause any problems. That is, it has been found that the reinforcing strip 16 does not separate from the paper or otherwise suffer any significant adverse effects. This is probably due to the fact that the paper passes very quickly past the fuser, there is no significant force acting on the paper sheet tending to separate the film from the sheet, and, to the extent the layer 22 becomes tacky, it nevertheless is directly in contact with the paper and tends to stick to it.

The actual thicknesses of the layers depicted in FIG. 3 will vary depending upon the particular application. Typically the adhesive layer 22 will be very thin—only as thick as is necessary to achieve the desired adhesion. The outer adhesive layer 18 will be quite thin—again, merely thick enough to achieve the desired effect of allowing the toner to adhere. For example, the duPont films discussed above typically have an outer layer 18 of a thickness of about 0.00008 inches (about 0.002 mm), and an inner adhesive layer 22 of comparable thickness. The central layer 20, which comprises the bulk of the reinforcing strip 16, can be selected to be any suitable thickness. The duPont films identified above have an overall thickness in the range of about 0.0005–0.001 inches (about 0.014–0.025 mm)(including the adhesive layers 18 and 22). Films of other thicknesses may also be employed. As discussed above, such thin films can be partially or entirely recessed, or may be applied without recessing since they are thin enough on most tab sheet stock to add less than about ⅓ the thickness of the sheet stock, and desirably less than 1/5 such thickness.

Figure 7:
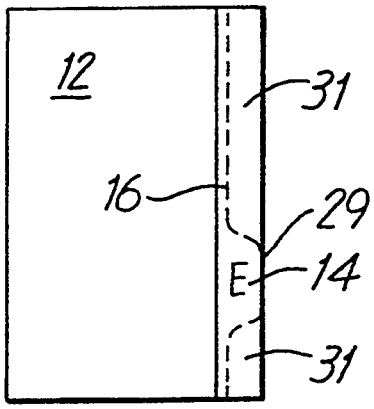
FIG. 7 is a plan view of a reinforced paper sheet prior to having the tab cut into an edge thereof.

FIG. 7 depicts a paper sheet to which a reinforcing film has been applied, prior to trimming of the edge portion 31 to produce the tab 14.

Figure 8:
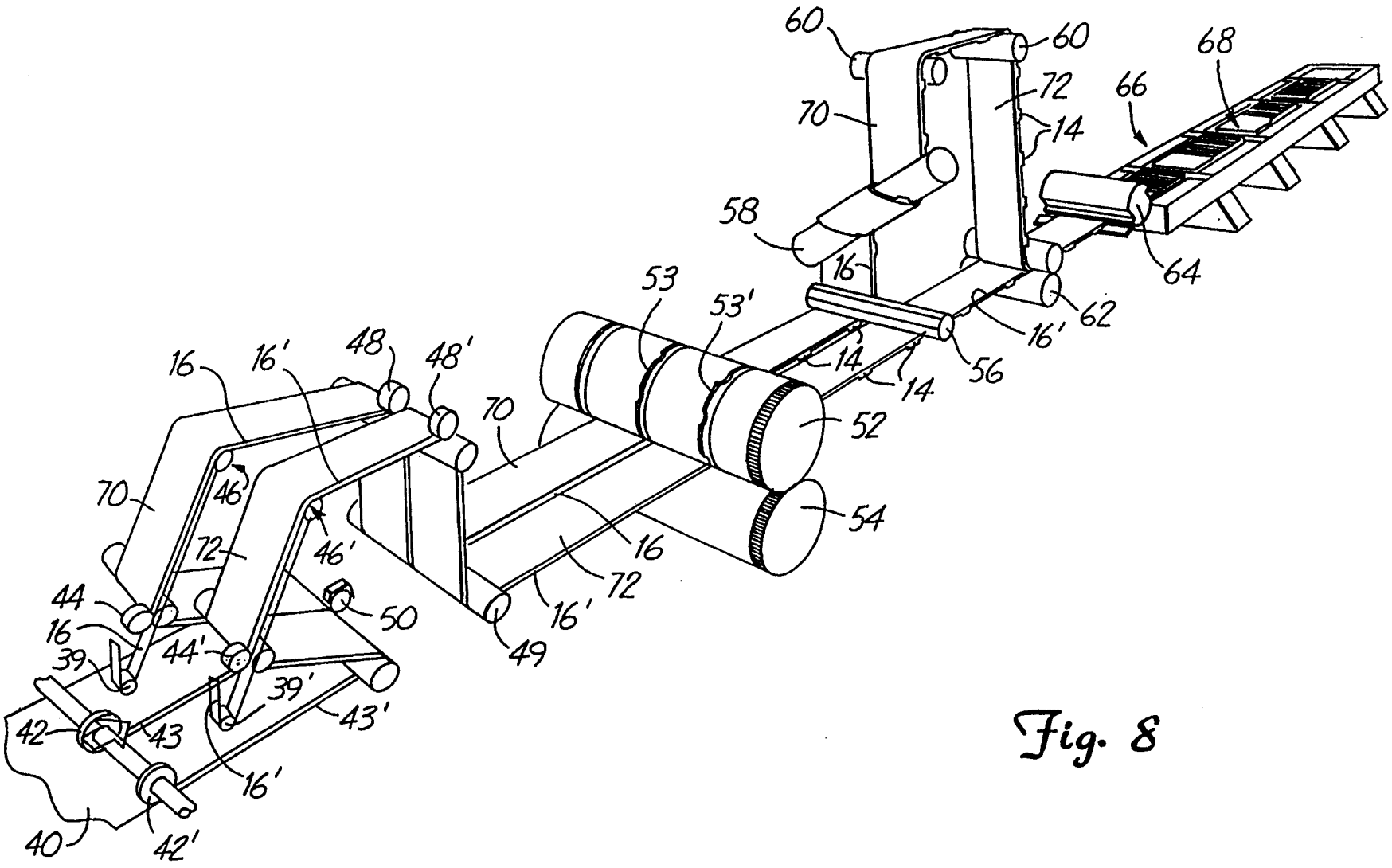
FIG. 8 is a perspective schematic view of a method of manufacturing collated tabs according to the invention.

FIG. 8 depicts one method of manufacturing the reinforced tabbed sheets of the invention. A continuous paper web 40, which desirably is twice as wide as the finished tabbed sheets (other widths, in multiples of the finished sheet width, may also be used) is fed to recessing rollers 42 and 42' which form grooves 43 and 43' of the desired depth and width in the web 40. The web 40 then passes a center slit wheel 50 which cuts the web into two separate webs 70 and 72 of equal width.

Two strips of reinforcing film 16 and 16' are fed past rollers 39 and 39' to nip rolls 44 and 44' where they are secured (with the selected adhesive) in the grooves 43 and 43'. The webs 70 and 72 then pass a flip around plow 46, 46' which folds the film 16 and 16' around the edge of the web. The webs then pass through nip rolls 48 and 48' which firmly press the film 16, 16' onto the webs 70, 72. If the reinforcing film 16 is to be applied to only one side of the tabs 14, then the film 16 will be correspondingly narrower and the plows 46, 46' would not be needed.

The webs then pass around roller 49 and proceed to the cutting die 52 and its anvil 54. The die is provided with cutting rules 53, 53' that cut, in sequence, one tab for each position in the set. For purposes of illustration, each rule on the die 52 of FIG. 8 has five tab positions (corresponding to the five positions shown in the booklet of FIG. 1); only some of those tab positions are actually visible in the drawing.

At this point in the process, the webs 70, 72 could be immediately cut into individual sheets, as by fly knife 64. This would result in two separate stacks of tab sets, each set having five sheets, one each of the five tab positions (obviously, the die can be changed to produce sets of tabs having any number of tab positions).

The Xerox duplicating systems referred to above, however, are set up to utilize sets of tabs where each set includes two tabbed sheets each (positioned adjacent one another) for each of the five tab positions. That is, each set of tabs includes ten sheets, two sheets each for each of the five tab positions. The manufacturing method depicted in FIG. 8 automatically assembles the tabbed sheets in this preferred configuration. One of the webs, 70, passes around turnbar 58 to laterally move it over to a position directly above the other web 72. The web 70 then passes around compensator rollers 60 and is matched with the other web 72 at the web drive nip rollers 62. (The compensator rollers 60 are spaced so that when the web 70 meets the other web 72, the tab positions of the two webs will correspond exactly with one another.) Fly knife 64 then cuts the matched webs into individual sheets, which are stacked on delivery/-batcher 66 in the desired sets 68 of ten sheets each. No further collation (which introduces the possibility of error) is necessary prior to use of the sets in a duplicating system, thereby giving an extremely high confidence level that the various tabbed sheets are in the order in which the automated duplicating system assumes they will be in (thereby reducing the possibility that virtually an entire run of booklets will have all the tabs in the wrong position because one tab was missing or improperly collated prior to the sets of tabs being loaded into the duplicating system).

Figure 9:
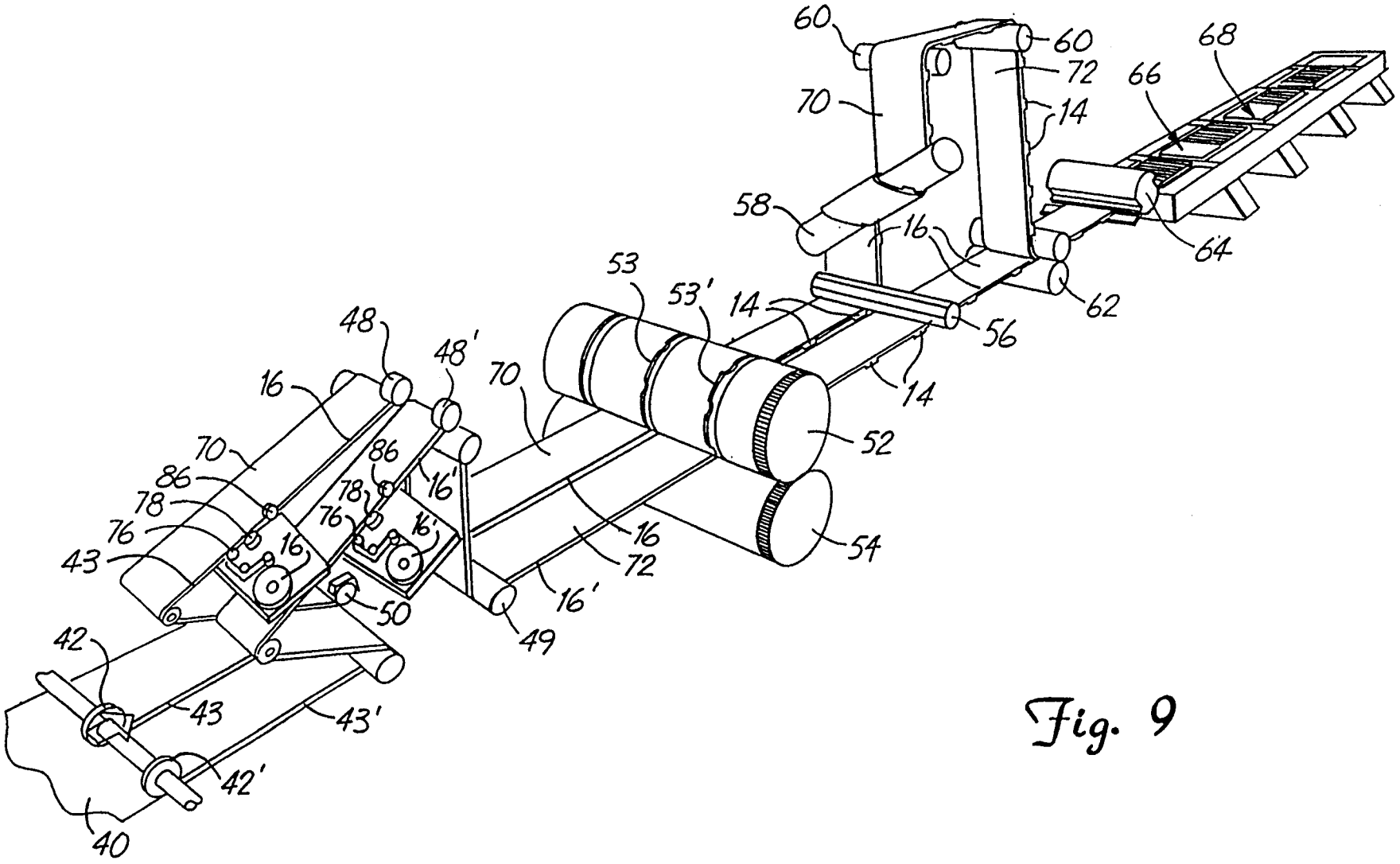
FIG. 9 is a schematic view of an alternate embodiment for applying reinforcing film to both sides of tabbed sheets.
Figure 10:
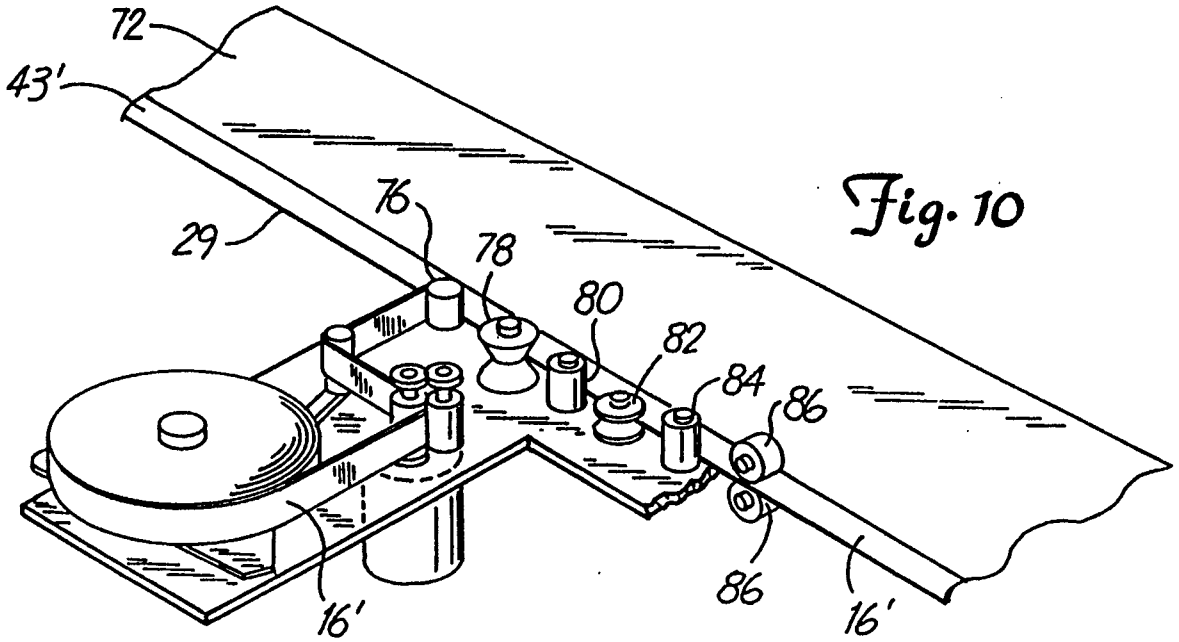
FIG. 10 is a broken-away view of a portion of FIG. 9.

FIGS. 9 and 10 depict an alternate manufacturing method, particularly suited for use when a heat activatable adhesive is used to secure the reinforcing strip 16, 16' to the web (FIG. 8 being more suitable for solvent-based adhesives). In this embodiment the film 16' is directed, through a series of rollers to a hot-wheel 76 which heats the film 16' to active the low temperature heat activatable adhesive on one side of the film 16'. A second series of rollers 78, 82 and 84 then folds the film 16' around the edge 29 of the web 72, and nip rollers 86 firmly press the film onto the web to complete the process (for the sake of clarity, not all of these rollers' are shown in FIG. 9—See FIG. 10).

It will be understood that other methods of manufacturing the tabbed sheets of the invention may be utilized, including processes which do not use the five-around die but rather use a one or two around die (or equivalent means for cutting the desired tabs), followed by conventional collation methods to collate the tabbed sheets into sets.

In use, tabbed sheets 12 having a reinforcing strip 16 applied in a recess formed in the sheet can be loaded into conventional or specialized xerographic reproduction equipment. The fact that the portion of the sheet carrying the reinforcing strip is of substantially uniform thickness means that the stack of sheets will be substantially level, with no undue buildup of thickness on the reinforced side, making the sheets usable in most reproduction equipment. If the reinforcing film is of the type described above with an outer adhesive layer receptive to xerographic toner, high quality and durable custom images may be reproduced on the film.

While a preferred embodiment of the present invention has been described, it should be understood that various changes, adaptations and modifications may be made therein without departing from the spirit of the invention and the scope of the appended claims.

What is claimed is:

1. A reinforced paper tab comprising a paper sheet having top and bottom surfaces, an edge portion having a laterally extending tab, and a reinforcing film permanently secured to at least one of the surfaces of the tab, the combined thickness of the tab and reinforcing film being not more than about one-third greater than the thickness of the paper sheet, the reinforcing film comprising a polyester film having inner and outer sides, the inner side being secured to the sheet and the outer side carrying a thermally activatable adhesion layer.

2. The reinforced paper tab of claim 1 wherein the thermally activatable adhesion layer is melt compatible with thermoplastic xerographic toner so that the reinforcing film will accept and retain a xerographically reproduced image.

3. The reinforced paper tab of claim 1 wherein the reinforcing film is permanently secured to the surface of the paper sheet by a thermally activatable adhesive which is activatable at a temperature lower than the temperature at which the thermally activatable adhesion layer is activated.

4. A reinforced paper tab comprising a paper sheet having top and bottom surfaces., an edge portion having a laterally extending tab, and a reinforcing film permanently secured to at least one of the surfaces by a thermally activatable adhesive, the film having an outer surface carrying an adhesion layer that is thermally activatable at a temperature substantially higher than the activation temperature of the thermally activatable adhesive.

5. The reinforced paper tab of claim 4 wherein the thermally activatable adhesion layer is melt compatible with thermoplastic xerographic toner so that the reinforcing film will accept and retain a xerographically reproduced image.

6. A reinforced paper tab comprising a paper sheet having top and bottom surfaces, an edge portion having a laterally extending tab, and a reinforcing film permanently secured to one of the surfaces of the tab, the film being recessed into the tab so that the thickness of the tab is substantially no greater than the full thickness of the remaining portion of the sheet, the film having upper and lower sides, the lower side being secured to the sheet and the upper side carrying a thermally activatable adhesion layer.

7. The reinforced paper tab of claim 6 wherein the thermally activatable adhesion layer is melt compatible with thermoplastic xerographic toner so that the reinforcing film will accept and retain a xerographically reproduced image.

8. The reinforced paper tab of claim 7 wherein the adhesion layer softens at about 400° F. or less.

9. A method of xerographically copying an image onto a transparent substrate, comprising the steps of providing a transparent film having a coating of a thermally activatable adhesion layer that is melt compatible with a xerographic toner, xerographically applying the toner to the adhesion layer in the form of the image, and heat fusing the toner to the adhesion layer.

10. The method of claim 9 wherein the adhesion layer softens at about 400° F. or less.

11. The method of claim 9 wherein the transparent film comprises a polyester film.

12. The method of claim 11 wherein the adhesion layer softens at about 400° F. or less.

* * * * *